US012135188B2

(12) United States Patent
White et al.

(10) Patent No.: US 12,135,188 B2
(45) Date of Patent: Nov. 5, 2024

(54) REFLECTOR SIGHT FOR FIREARMS

(71) Applicant: Shield Corporation Limited, Bournemouth (GB)

(72) Inventors: James White, Bournemouth (GB); Mathew Courtice, Bournemouth (GB)

(73) Assignee: Shield Corporation Limited, Bournemouth (GB)

( * ) Notice: Subject to any disclaimer, the term of this patent is extended or adjusted under 35 U.S.C. 154(b) by 2 days.

(21) Appl. No.: 18/149,630

(22) Filed: Jan. 3, 2023

(65) Prior Publication Data

US 2024/0011738 A1 Jan. 11, 2024

(30) Foreign Application Priority Data

Jan. 12, 2022 (GB) ..... 2200320

(51) Int. Cl.
*F41G 1/30* (2006.01)
*F41G 11/00* (2006.01)

(52) U.S. Cl.
CPC ..... *F41G 1/30* (2013.01); *F41G 11/001* (2013.01)

(58) Field of Classification Search
CPC ..... F41G 1/30; F41G 11/001
USPC ..... 42/113
See application file for complete search history.

(56) References Cited

U.S. PATENT DOCUMENTS 8,186,093 B1 * 5/2012 Chung ..... F41G 1/35 42/119
10,139,197 B1 * 11/2018 Horton ..... F41G 1/383
10,234,238 B1 3/2019 Thomas et al.
11,493,303 B1 * 11/2022 Drake ..... F41G 1/14
2009/0193705 A1 * 8/2009 LoRocco ..... F41G 1/30 42/123
2016/0033232 A1 * 2/2016 Cheng ..... F41G 1/345 42/114
2016/0102943 A1 * 4/2016 Teetzel ..... F41G 1/35 42/113
2018/0128574 A1 * 5/2018 Crispin ..... G02B 23/105
2021/0215457 A1 * 7/2021 White ..... F41G 1/14
2021/0318099 A1 * 10/2021 Holly ..... F41G 11/002
2022/0034629 A1 * 2/2022 Hamilton ..... F41G 1/30
2022/0074705 A1 * 3/2022 Toy ..... F41G 1/30
2022/0136802 A1 * 5/2022 Toy ..... G02B 23/14 42/113
2022/0282953 A1 * 9/2022 Lee ..... G02B 23/16
2022/0390206 A1 * 12/2022 Hamilton ..... F41G 1/345
(Continued)

FOREIGN PATENT DOCUMENTS

GB 2487002 A 7/2012

OTHER PUBLICATIONS

Search Report for Application No. GB2200320.6, dated Jul. 1, 2022, 3 pages.

(Continued)

*Primary Examiner* — Samir Abdosh
(74) *Attorney, Agent, or Firm* — DINSMORE & SHOHL LLP

(57) ABSTRACT

There is provided a reflector sight for a firearm. The sight comprises a base, a housing arranged on the base together defining an inner chamber, and a light source, wherein the base comprises a bridge defining a tunnel therethrough, and wherein the light source is arranged with respect to the base to emit light through the tunnel and into the chamber.

16 Claims, 8 Drawing Sheets

(56) References Cited

U.S. PATENT DOCUMENTS

| | | | | |
|---|---|---|---|---|
| 2023/0176387 | A1* | 6/2023 | Sabaldan Elpedes | G01J 1/0411 362/23.19 |
| 2023/0185074 | A1* | 6/2023 | Crispin | F41G 1/38 359/428 |
| 2024/0011738 | A1* | 1/2024 | White | F41G 11/001 |
| 2024/0011740 | A1* | 1/2024 | Grace | F41G 1/345 |

OTHER PUBLICATIONS

European Patent Office, Extended European Search Report for EP Application No. 22275168.7, dated May 16, 2023, 9 pages.

* cited by examiner

DETAIL E

REFLECTOR SIGHT FOR FIREARMS

CROSS-REFERENCE TO RELATED APPLICATIONS

This application claims priority to United Kingdom Application No. GB2200320.6. filed Jan. 12, 2022, the entire contents of which are incorporated herein by reference.

INTRODUCTION

The present disclosure concerns reflector sights for firearms. The disclosure also concerns reflector sight assemblies and firearms including reflector sights.

Reflector sights for firearms are well known. Reflector sights tend to be either open, wherein the light beam travels through a region which is open to the environment, or closed, wherein the light beam is entirely enclosed. The front of the sight is taken to be the side facing towards the target when the sight is mounted on a firearm during use. The rear of the sight is taken to be the side facing towards the user when the sight is mounted on a firearm during use. A closed sight typically comprises a housing incorporating front and rear windows (i.e. transparent screens), and a lens inside the housing onto which the reticle is projected.

Closed sights tend to provide a robust and weather-proof design, useful for harsh conditions wherein rain, snow, dust or other foreign matter would otherwise be problematic. Closed sights therefore offer a high level of reliability and tend to be favored for use in combat applications. A drawback with closed sights is increased weight and bulk, and a requirement for a specific mount due to the larger size. The Applicant's own switchable interface sight (SIS) is an example of such a closed sight.

There is a desire now to further improve on existing closed sight designs, particularly to provide a more compact closed sight with a considerably reduced size, so that the sight can be used interchangeably with an open sight on the same mount.

Aspects described herein seek to mitigate the above-mentioned problems. Alternatively or additionally, aspects described herein seek to provide an improved reflector sight.

SUMMARY

In a first aspect, there is provided a reflector sight for a firearm, comprising: a base; a housing arranged on the base, together defining an inner chamber; and a light source; wherein the base comprises a bridge defining a tunnel therethrough; and wherein the light source is arranged with respect to the base to emit light through the tunnel and into the chamber.

The reflector sight may be a closed sight. A closed sight is known in the art to mean a sight wherein the light path is enclosed (i.e. not exposed to the external environment).

The inventors have recognized that by incorporating a bridge on the base of the sight, a more compact closed sight is provided. The tunnel provides a pathway for light to pass into the chamber without obstruction by the base, whilst simultaneously creating space within the base for the repositioning of the mounting holes used to fix the sight onto the mount (i.e. mounting plate or slide). Thus, the mounting holes can be positioned forward of the light source (i.e. closer to the target), rather than rearward, as has been the state of the art for closed sights. As such, the footprint of the sight is reduced, and can be made to match standard footprints already used in the industry for smaller, open sights. This provides a significant benefit to the user, who can interchange the reflector sight as described herein with existing open sights, without needing any reconfiguration of the firearm mount.

Building a bridge onto the base of a sight is counterintuitive, since it partially obstructs the field of view. However, the inventors have discovered that during use which tends to be with two eyes open, the bridge itself becomes essentially invisible to the user, whilst the reflected reticle is superposed over the top.

The housing may be six sided. The chamber may be substantially cuboidal. The weight of the sight may be no more than 55 g, for example in the range 40-50 g. The base may comprise a first portion which is covered. The base may comprise a second portion which is exposed (i.e. open to the external environment).

The base may comprise a top surface. The bridge may be raised up from (i.e. upstanding on) the top surface. The bridge may be external to the chamber. The bridge may adjoin an external surface of the housing.

The light source may comprise one or more LEDs. The sight may be a red dot sight. The light source may be attached to the base, held by the base, or otherwise associated with the base.

The bridge may be adjacent the housing. The bridge may be adjoined to the housing. The bridge may comprise one or more walls, wherein the walls have a maximum thickness of less than 1.5 mm.

The tunnel may be defined in part by the base and in part by the bridge. The tunnel may extend beneath the top surface of the base. The tunnel may be partially within the base and partially above the base. The light source may be positioned beneath a top surface of the base. The tunnel may extend beneath a top surface of the base to a lower tunnel end, and the light source may be mounted at the lower tunnel end.

The tunnel may be positioned between the light source and the chamber. The light source may be mounted on one end of the tunnel, to emit light directly into the tunnel. The tunnel may be straight, such that the emitted light follows a direct and unobstructed path to the chamber.

The sight may comprise a lens within the chamber, wherein the light source is positioned at the focal point of the lens. The housing may comprise a front window (wherein front is taken to be the side facing the target during use). The front window may comprise a transparent panel. The housing may comprise a rear window (wherein rear is taken to be the side facing the user during use). The rear window may comprise a transparent panel. The rear window may be adjacent the bridge, for example the bridge may adjoin the rear window. When viewed from the rear, the bridge may cover a surface area which is less than 10%, for example 7%, of the external surface area of the rear window. The housing may comprise a roof. The housing may comprise two or more sides.

The bridge may be taken to have a front end and a rear end (along a longitudinal axis of the bridge), wherein the front end is the end nearer the target during use, and the rear end is the end nearer the user during use. The bridge may comprise a cover, for example over one end. In other words, the bridge may be capped at one end. The covered end may be the rear end. The cover may be transparent. The use of a transparent cover may improve viewing of the reticle (since it can be viewed through both the rear window and transparent cover), whilst minimizing the obstructive effect of the bridge within the field of view.

The rear end of the bridge may be angled with respect to an upper surface of the base. The cover may be angled with respect to an upper surface of the base. The cover may be tilted towards the front of the sight (i.e. sloping away from the user during use).

The chamber may be sealed (i.e. the sight may be waterproof). The chamber may be sealed by a combination of the base, the roof of the housing, the sides of the housing and the front and rear windows of the housing, together with the bridge (including cover). A sealed sight may be particularly desirable for use in harsh environments.

The bridge may be elongate, i.e. having a maximum length which is greater than its maximum width and its maximum height. The bridge may have an approximately square, or approximately rectangular, cross-section. The cross-sectional area of the bridge may increase with distance towards the front of the sight (i.e. closer to the target). The increase in size may be continuous with distance towards the front of the sight.

The bridge may have a maximum height which is less than one half, for example less than one third of a maximum height of the rear window. The bridge may have a maximum width which is less than one half of a maximum width of the rear window. The bridge may have an average width which is less than one half, for example less than one third of a maximum width of the rear window (wherein the average width is taken to be the width of the bridge at half its maximum height, and half its maximum length). The bridge may obstruct approximately 5-10% for example 7-9% of the surface area of the rear window of the sight. The bridge may comprise walls, for example comprising a roof and two side walls. The walls may be elongate walls. The walls may have a variable thickness along the length of the bridge. The maximum thickness may be less than 2 mm, for example less than 1.5 mm. The walls may have a thickness between 1-2 mm thick along their full length, for example between 1-1.5 mm thick. The walls of the bridge may thus be sufficiently thick to provide strength, but be thin enough to minimize obstruction of the rear window of the sight.

The bridge may have rounded edges. The rounded edges may extend along the full length of the bridge.

The bridge may be aligned centrally on the base. The bridge may be aligned along a central longitudinal axis of the sight.

The housing may comprise a front window and a rear window, the front window being closer to the target during use, and the rear window being closer to the user during use, wherein the bridge adjoins the rear window. The bridge may obstruct a portion of the rear window when viewed from the rear.

The sight may comprise a lens in the chamber. The lens may be a convex lens. The lens may bisect the chamber. The light source may be positioned at the focal point of the lens.

The light source may be mounted at one end of the tunnel.

The bridge may be formed integrally with the base. The housing may be formed integrally with the base.

The base may comprise holes for receiving mounting screws. The holes may be threaded. The holes may extend through the full depth of the base. The holes may be positioned forward of the light source (i.e. closer to the housing than the light source). The holes may be positioned between the light source and the housing. There may be one or more holes, optionally two holes for receiving mounting screws. The holes may be located on the base in a position such that the base fits onto a mount designed for an open sight. The mount may be a mounting plate or a firearm slide which has been machined to receive a certain footprint of sight. The reflector sight described herein may therefore be said to have a standard (i.e. known in the art) footprint.

The base may have a maximum width of less than 30 mm, optionally less than 27 mm. The base may have a maximum width in the range of 24-26 mm. The base may have a maximum length of less than 45 mm, optionally less than 43 mm. The base may have a maximum length in the range of 39-41 mm.

The base may comprise, in addition to the holes for receiving mounting screws, one or more, optionally four, locating recesses for receiving locating pegs of a complementary sized mount.

In a second aspect, there is provided a reflector sight assembly comprising the reflector sight of the first aspect, and a mount configured to hold the sight. The mount may be a mounting plate configured to attach to the firearm. The mount may be a portion of a slide of the firearm. The mount may have dimensions which are slightly larger than the sight so that the sight can fit inside the perimeter of the mount. The perimeter of the mount may comprise a raised lip. The mount may comprise four upstanding locating pegs, each having a height of approximately 1 mm. During use, when the sight is mounted on the mount, the locating pegs of the mount may be inserted in the locating recesses of the base of the sight.

The mount may have a footprint which matches the Applicant's Glock MOS low profile mounting plate designed for the Reflex Mini Sight, Shield Mini Sight and Jpoint Sight products. The sight of the reflector sight assembly may therefore be interchangeable on the same mount, with the Reflex Mini Sight, Shield Mini Sight and Jpoint Sight products.

In a third aspect, there is provided a firearm including the reflector sight assembly of the second aspect.

In a fourth aspect, there is provided a closed reflector sight for mounting on a firearm, the sight comprising: a base comprising a housing, and adjacent the housing a raised bridge portion, and a light source arranged with respect to the base to emit light through the raised bridge portion and into the housing.

It will of course be appreciated that features described in relation to one aspect of the present disclosure may be incorporated into other aspects of the present disclosure. For example, a method may incorporate any of the features described with reference to an apparatus and vice versa.

DESCRIPTION OF THE DRAWINGS

Aspects will now be described by way of example only with reference to the accompanying schematic drawings of which.

DETAILED DESCRIPTION

Figure 1:
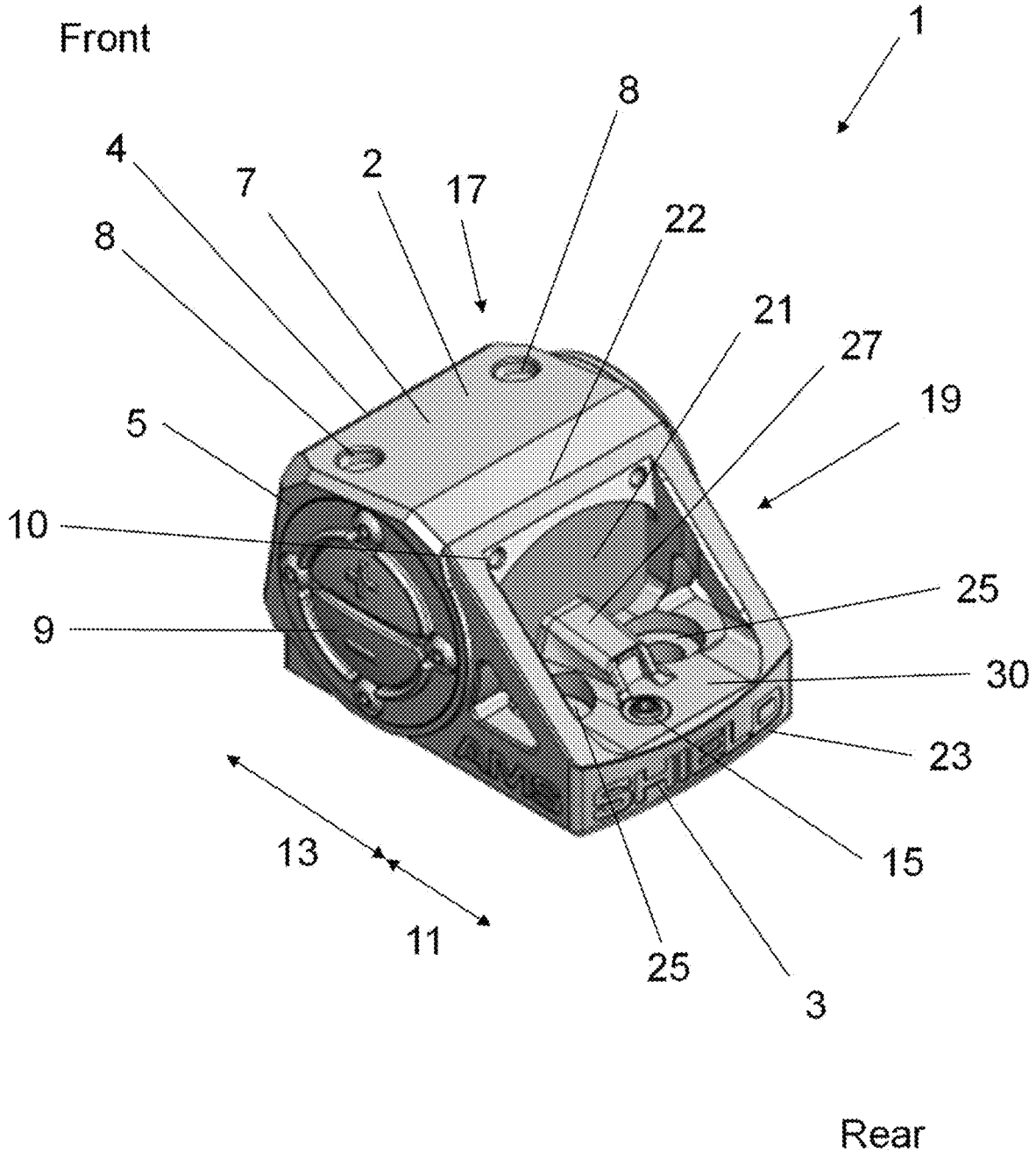
FIG. 1 is a perspective view of a reflector sight according to an example embodiment.

A reflector sight 1 according to the example embodiment (FIG. 1) comprises a housing 2 on a base 3. The base 3 has a roughly rectangular footprint (i.e. the two-dimensional surface area of the underside of the base).

In the present example embodiment, the footprint of the sight 1 (as defined by the size and shape of the underside of the base 3) is of a standard size known in the industry. The sight 1 of the present example embodiment can therefore be interchanged on a firearm slide, with other existing sights which have been manufactured to have the same footprint, for example using a common mount. In the present example embodiment, the sight base has a maximum length of 41 mm, and a maximum width of 25 mm. The sight base is significantly smaller than has previously been realized for a closed sight. The sight of the present example embodiment provides a closed sight having associated benefits of durability and all-weather performance, which is comparatively lightweight, which in an advancement on sights of the prior art, can fit onto existing mounting plates designed for small, open sights.

In the example embodiment, the housing 2 comprises two opposing upstanding side walls 5 and a flat roof 7 extending therebetween. The side walls 5 are approximately trapezoidal in shape, extending substantially perpendicularly up from the base 3. The trapezoidal side walls 5 have a steeply inclined front portion 17, and a shallowly inclined rear portion 19. The roof 7 is substantially horizontal, opposing the substantially horizontal plane of the base 3. The housing 2 further comprises a front window (not shown in FIG. 1), extending down from the front edge 4 of the roof 7 to the base 3. The housing 2 further comprises a rear window 21, extending down from the rear edge 22 of the roof 7 to the base 3. The rear window 21 extends in a substantially perpendicular direction between the base 3 and roof 7. The front window (not shown in FIG. 1) is angled with respect to the base 3.

The base 3 is notionally split into a rear portion 11 and a front portion 13. The roof 7 extends over the front portion 13 of the base 3 (but in the present example embodiment, not over the rear portion 11 of the base 3). The side walls 5 of the sight 1 run adjacent both the front portion 13 and rear portion 11 of the base 3. The side walls 5 slope down to meet the rear bottom edge 23 of the sight 1. The rear parts of the side walls 5 (i.e. the parts of the side walls above the rear portion 11 of the base 3) effectively define a triangular wing on either (left and right hand) side of the sight 1. The side walls 5 therefore, help to protect the rear portion 11 of the sight 1 from damage.

The rear portion 11 of the base 3 comprises a bridge 27 (i.e. a hollow raised portion) protruding up from the top surface of the base 3. The bridge 27 is positioned centrally across the width of the sight 1, and towards the rear of the front section 13 of the base, with its front end coplanar with the rear window 21.

The bridge 27 is elongate with an approximately rectangular cross-section, which varies along the length of the bridge. The cross sectional area of the bridge 27 is smaller towards the rear of the sight 1 and larger towards the front of the sight 1. The bridge 27 comprises a substantially flat roof, with substantially flat sides, and rounded corners.

Extending vertically through the rear portion 11 of the base 3 of the sight 1 are two holes 25 for receiving mounting screws, whereby the sight 1 can be screwed onto a mount (not shown) or directly to a firearm slide. The length of the sight has been considerably shortened by positioning the mounting holes 25 forwards of the bridge 27. This has not been easily accomplished and has required a re-design of the entire interior of the sight 1. In an advantage over sights of the prior art, aspects described herein provide a reflector sight that is robust and weather-proof yet is compact enough to fit onto existing mounts/slides machined for smaller, open sights.

Extending vertically through the rear portion 11 of the base 3 is an adjustment mechanism 15 for calibrating the sight 1 during use (to center the reticule and/or ensure co-witness with the iron sights where necessary). The adjustment mechanism 15 of the present example embodiment is of a type described in patent GB2573821, and not discussed further herein.

In the present example embodiment, the upper surface of the roof 7 comprises two circular locating indents 8, providing locating points onto which an accessory (not shown) may be mounted. The sight 1 also comprises, above the rear window 21, two fixing holes 10 for receiving screws whereby the accessory can be removably attached to the sight. The fixing holes 10 are arranged perpendicularly to the locating indents 8. Such an accessory may include a flip-up cover, torch, laser sight, secondary sight, additional battery, set of roll bars, honeycomb filter, solar charger, night vision cover or other accessory. Thus a more compact closed sight is provided without compromising functionality. Through enabling bolt-on accessories, the sight provides the functionality of a much larger sight.

Looking from the rear, the left-hand side wall 5 of the sight 1 incorporates a switch 9 on its outer face, for adjusting the brightness of the reticle. The right-hand side wall 5 incorporates a battery on its outer face (not shown in FIG. 1).

Figure 2:
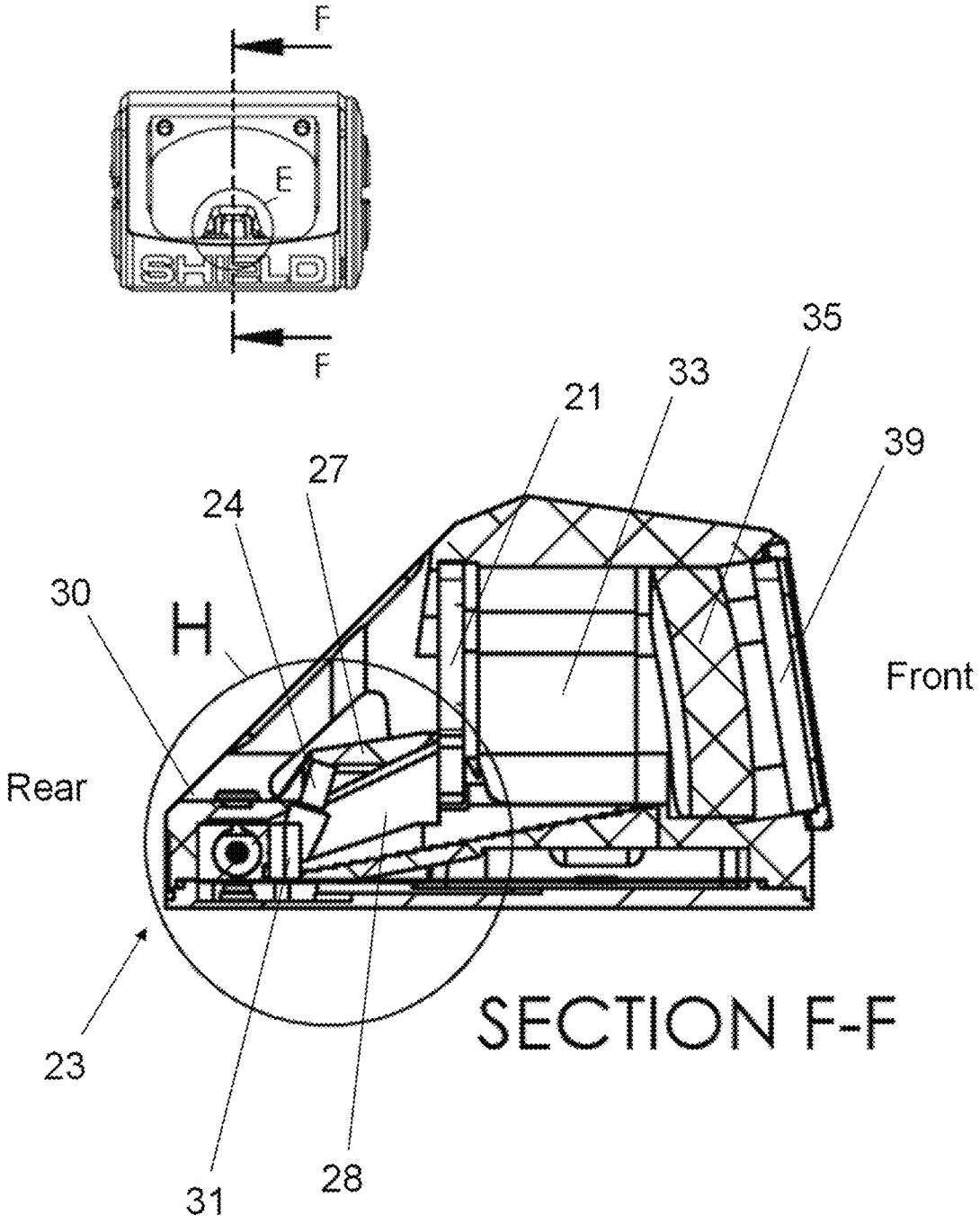
FIG. 2 is a sectional view of the reflector sight of FIG. 1 through F-F.
Figure 3:
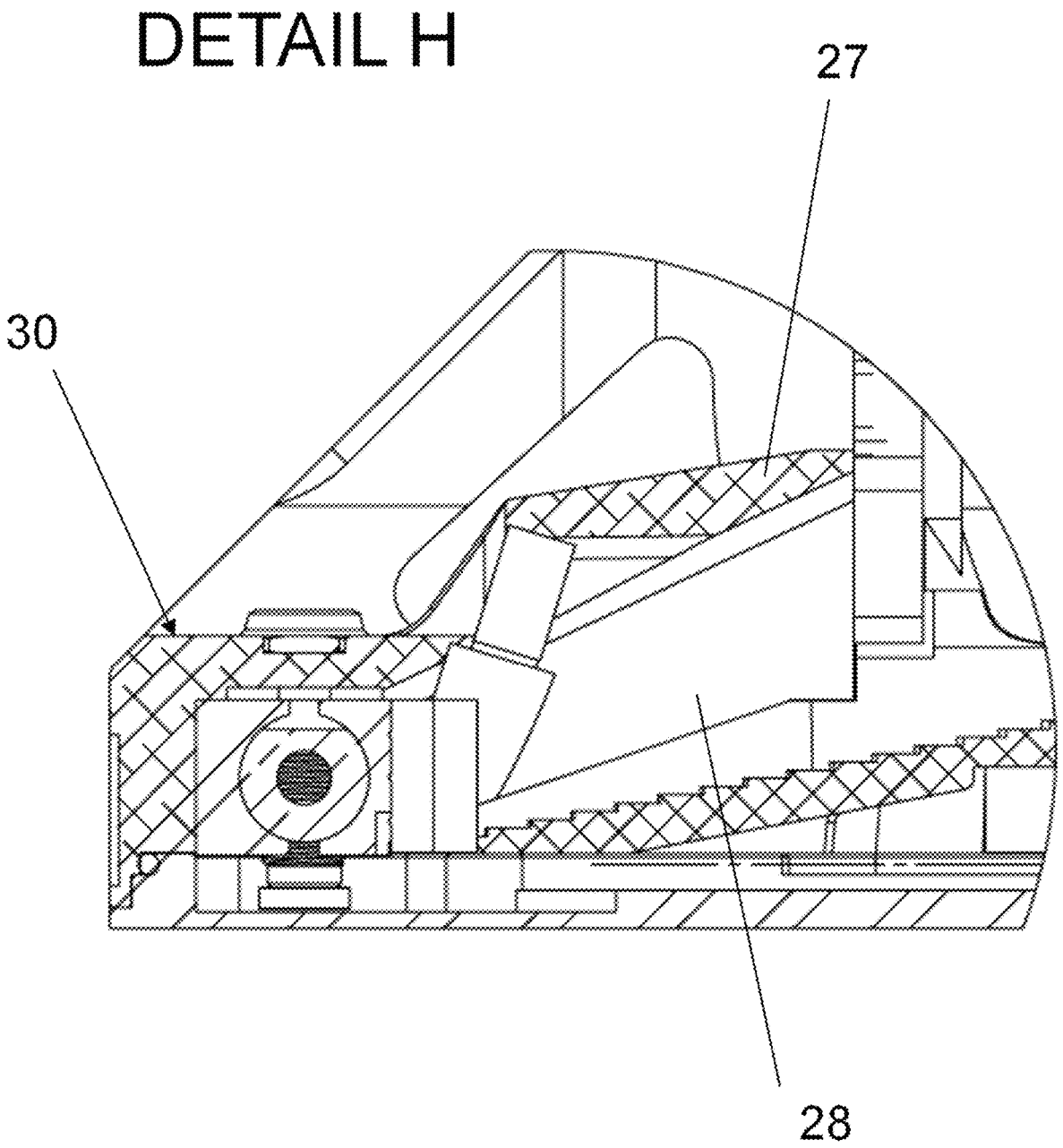
FIG. 3 is a close up view of Detail H of the sight of FIG. 2 (scale 5:1)

Within the housing 2 is a chamber 33 (FIG. 2). The chamber 33 is enclosed by the roof 7, the side walls 5, the front window, the rear window 21 and the base 3. The bridge 27 defines an interior tunnel 28 (e.g., an interior space) which enables the passage of light therethrough (FIGS. 2, 3). The bridge 27 and the base 3 together enclose the tunnel 28. The tunnel 28 extends down beneath the upper surface 30 of the rear portion 11 of the sight 1. The tunnel 28 slopes through the base 3 of the sight 1, towards the rear bottom edge 23 of the sight 1. An LED 31 is mounted at the rear end of the tunnel 28 and positioned to direct a beam of light up through the tunnel 28 and into the chamber 33 of the sight 1, where it reaches a lens 35, such as a convex lens. As is known in the art, the LED 31 is positioned at the focal point of the lens 35, such that the light is reflected back in a parallel beam from the lens 35 to the user's eye (creating an infinity image of the reticule over the target).

The rear opening of the bridge 27 is covered by a clear viewing panel 24, enabling the user to look through the tunnel 28. In the present example embodiment the chamber 33 is sealed (meaning watertight). The chamber 33 is sealed above by the roof 7, below by the base 3, at the front by the front window 39 (and the lens 35), on both sides by the side walls 5, and at the rear by the rear window 21 and bridge 27 together with the viewing panel 24. In another example embodiment, there may be no viewing panel 24, and the tunnel 28 may instead be open at its rear end, meaning that the chamber is not sealed, but still protected by way of the roof 7, side walls 5, front and rear windows 39, 21, and base 3.

If the bridge 27 were not present, due to the relatively short length of the sight 1 (compared to other closed sights) and the location of the mounting holes forwards of the LED, the light beam emitted from the LED light source would not reach the lens, as it would be obstructed by the base 3.

Figure 4:
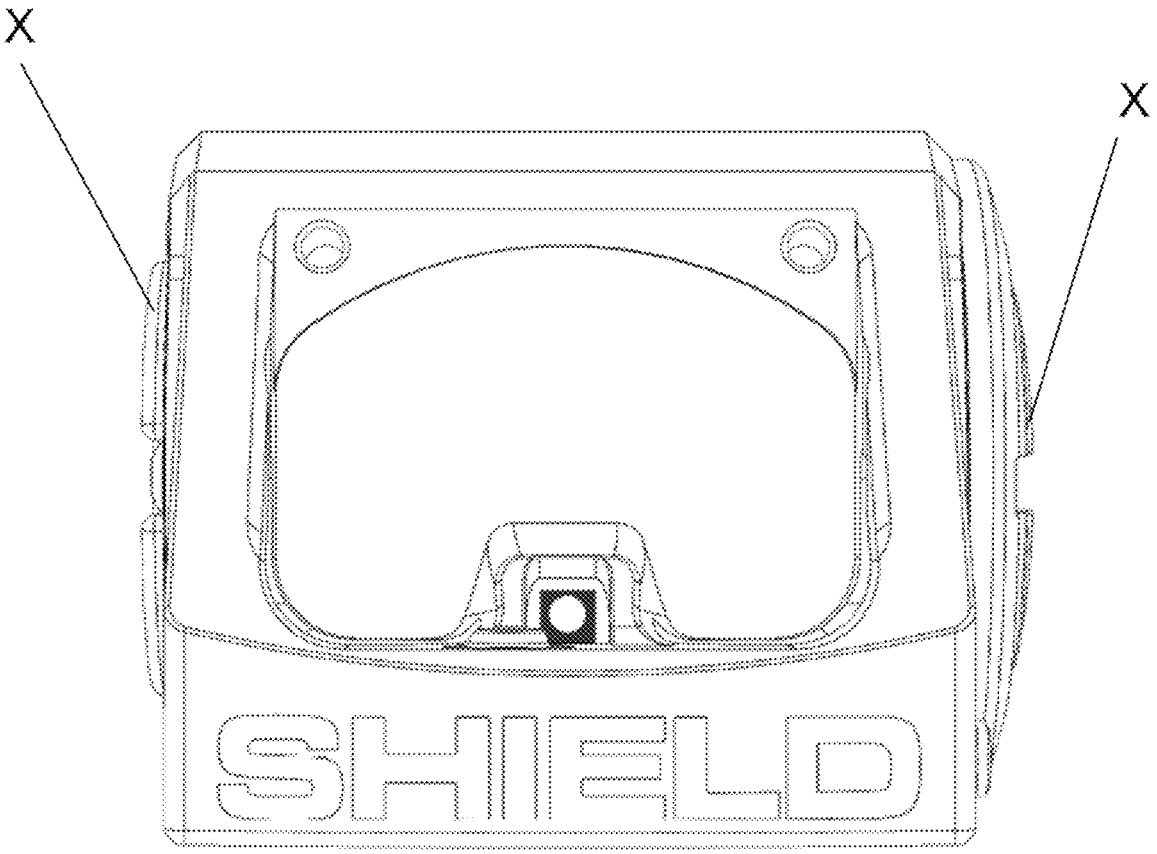
FIG. 4 is a rear view of the reflector sight of FIG. 1 on a firearm without iron sights.
Figure 5:
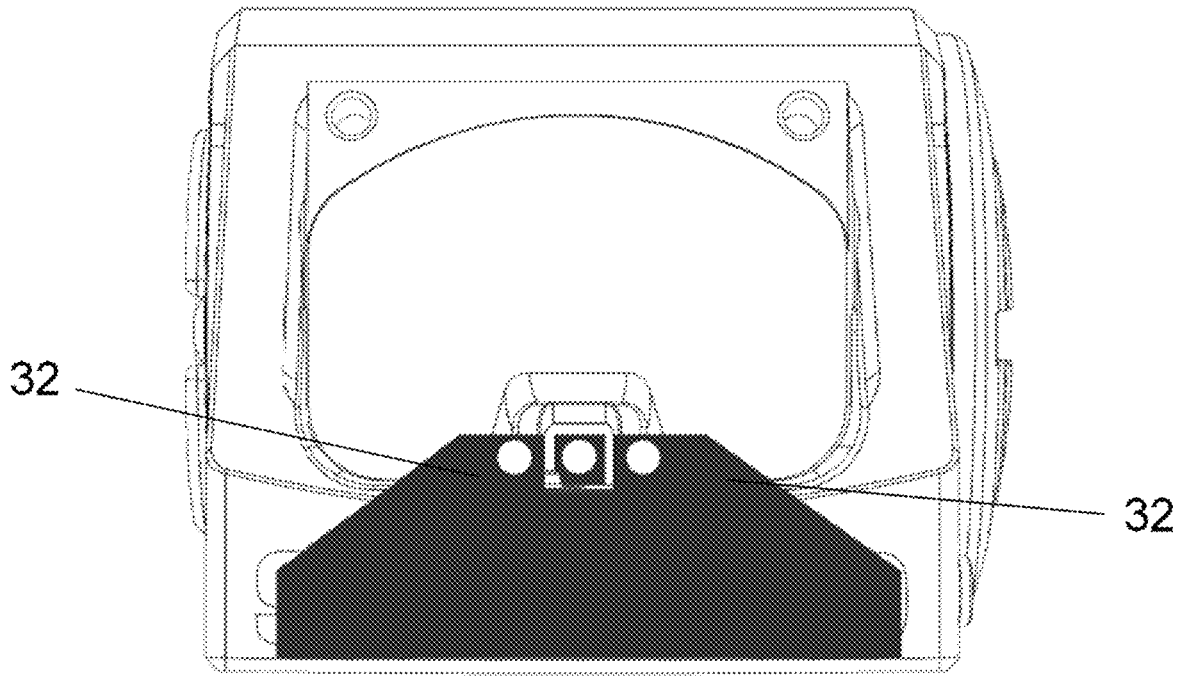
FIG. 5 is a rear view of the reflector sight of FIG. 1 on a firearm with iron sights.

In use, when the sight 1 of the present example embodiment is mounted on a firearm having no iron sight, the user relies on the reticle alone for sighting a target (FIG. 4). The user can make use of the tunnel for sighting the target, locating the reticle in the viewing panel 24, thus providing a co-witness between the bridge 27 and lens 35. However, when the sight 1 is mounted on a firearm having an iron sight, there is also an option of aligning the iron sights 32 with the lens and viewing panel 24, providing a further co-witness for ease of sighting the target (FIG. 5).

Figure 6:
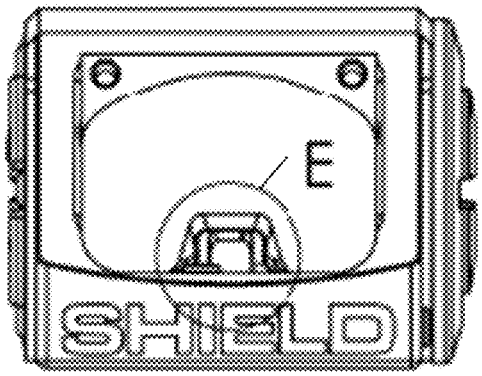
FIG. 6 is a close up view of Detail E of the sight of FIG. 1 (scale 5:1)
Figure 6:
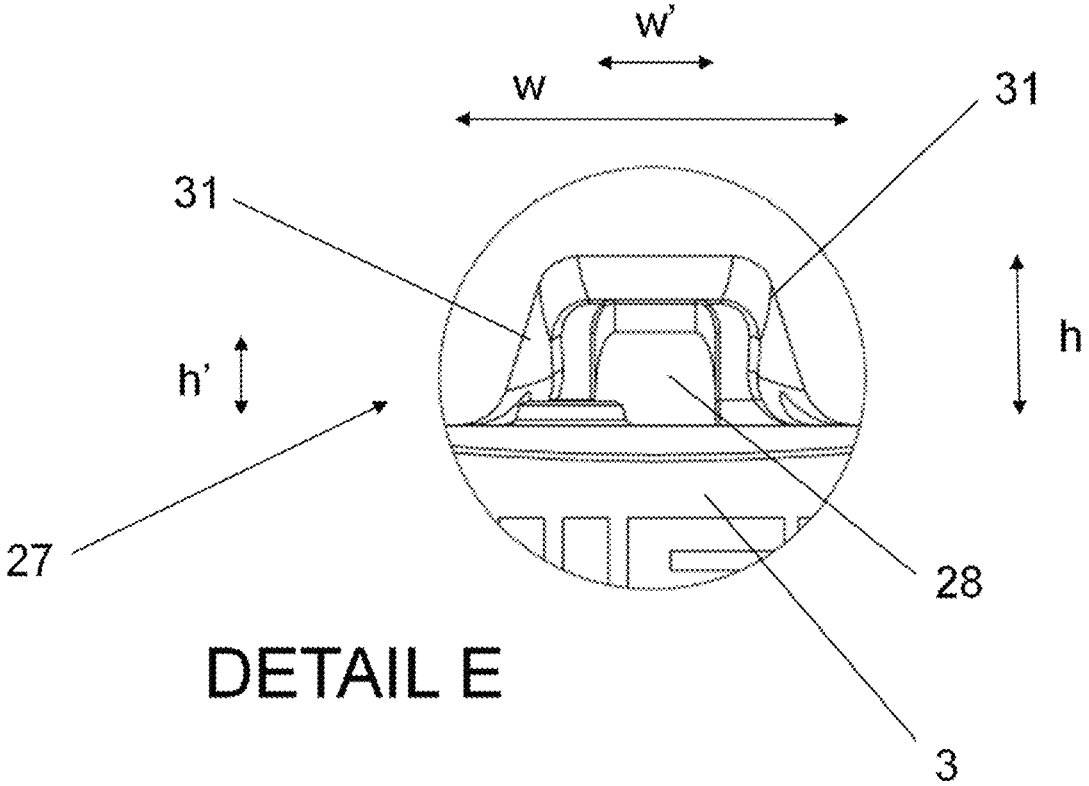

In the present example embodiment, the bridge 27 (FIG. 6) is formed integrally with the base 3 of the sight 1. The bridge 27 has an approximately rectangular cross-section (i.e. a width and a height) which varies along its length. The bridge 27 is sufficiently big to enable a user to look through the tunnel 28 formed by the bridge 27, yet not so big that it obstructs too much of the rear window 21. In the present example embodiment, the bridge 27 has a maximum external width, w of approximately 7-8 mm, and a maximum internal width, w' of approximately 3-4 mm. The bridge 27 has a maximum external height, h of approximately 4-5 mm, and a maximum internal height, h' of approximately 2-3 mm.

The bridge 27 in the present example embodiment has a roof and sides (together, taken to be the walls of the bridge). The walls of the bridge 27 are of a thickness of approximately 1-2 mm for providing an optimal balance between durability and minimizing obstruction of the user's view through the rear window. During use, since the sight 1 is used with both eyes open to view the reticle over the target, the walls of the bridge become almost invisible to the user, and the reticle remains in view (superposed over the bridge). The bridge 27 obstructs approximately 7-9% of the external surface area of the rear window 21 of the sight 1.

Figure 7:
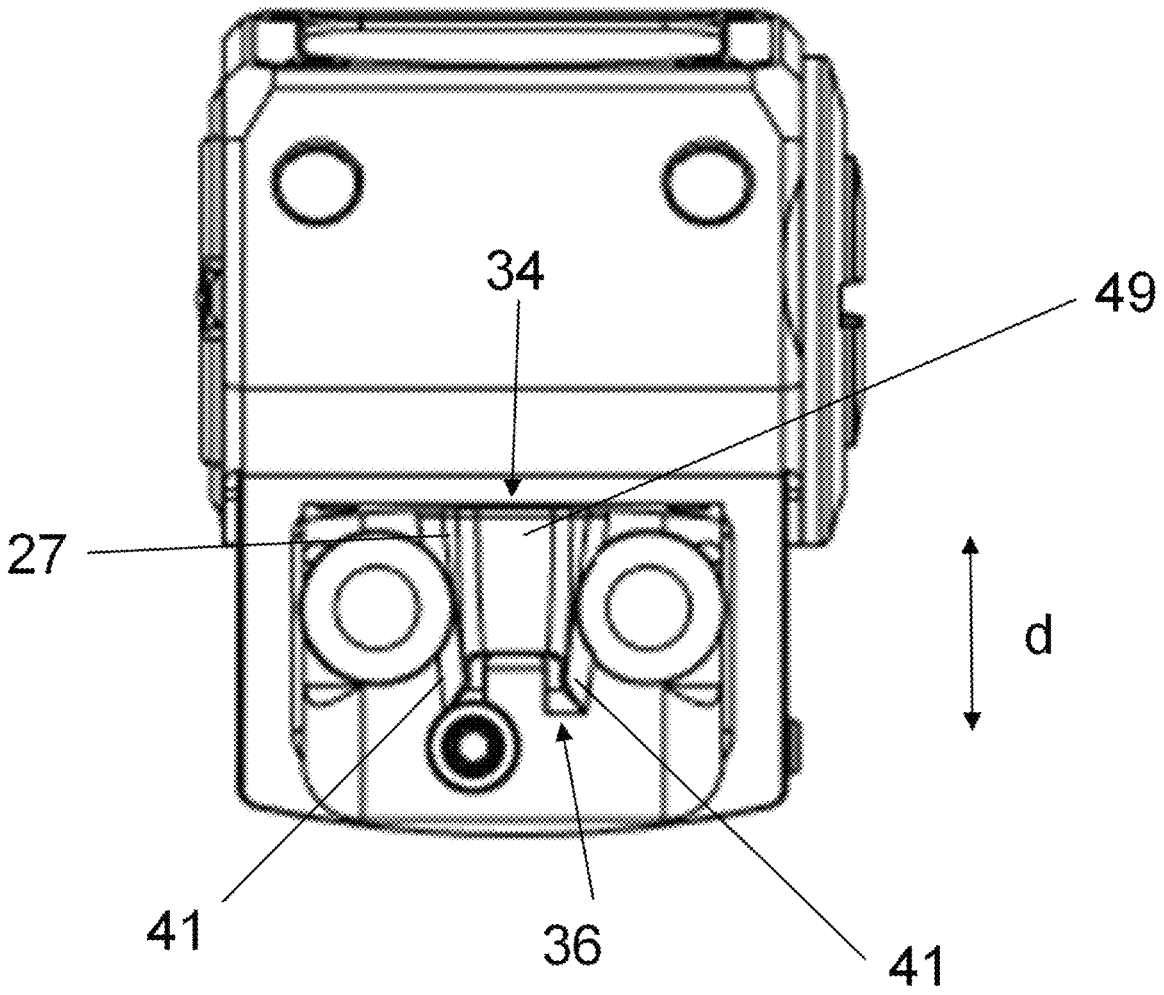
FIG. 7 is a top view of the reflector sight of FIG. 1.

As has been described above, the bridge 27 is tapered, having a larger (i.e. wider and taller) end 34 adjacent the rear window 21, and a smaller (shorter and narrower) end 36 towards the rear of the sight 1 (FIG. 7). The bridge 27 is thus shaped to facilitate the passage of the emitted light beam, whilst presenting the minimum possible obstruction in the field of view. The roof 49 of the bridge 27 stops short of the full depth, d, of the bridge 27. In the example embodiment, the maximum depth of the bridge, d, is approximately 10 mm. The rear edge of the bridge is angled back with respect to the base 3. The bridge comprises a roof 49 and side walls 41. The viewing panel 24 is angled back with respect to the base 3. The bridge side walls 41 extend further towards the rear than the bridge roof 49. The sloping of the rear edge of the bridge 27 helps to minimize the obstruction of the field of view by the bridge 27.

Figure 8:
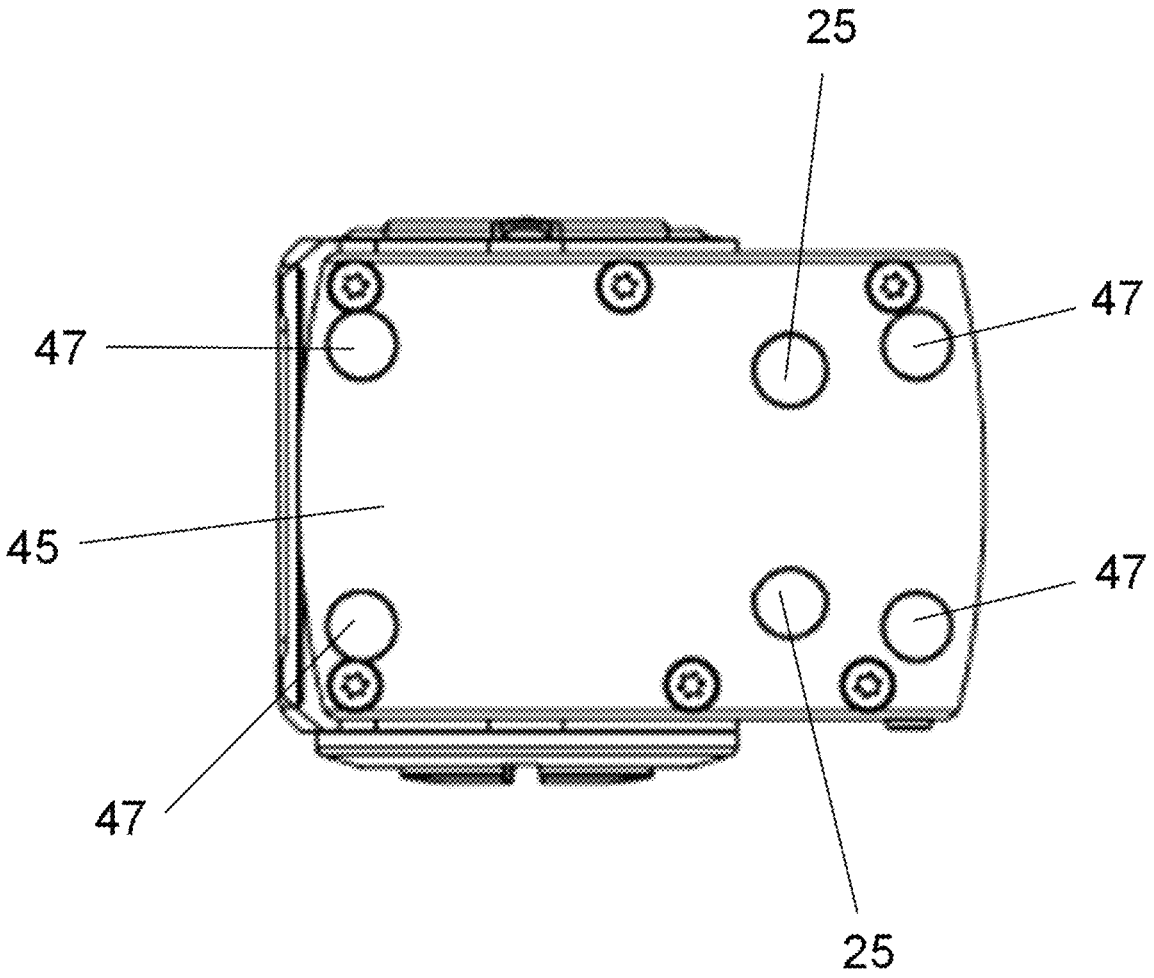
FIG. 8 is a bottom view of the reflector sight of FIG. 1.

The underside 45 of the base 3 (FIG. 8) includes, in addition to the mounting holes 25, four locating recesses 47 for locating corresponding locating pegs in a sight mounting plate (not shown).

To mount the sight 1 on a firearm, the sight 1 is screwed onto a mounting plate (not shown). Mounting plates may be separate components or may be machined into a firearm slide at manufacture. A single mounting plate can typically accommodate a number of different sights all having the same footprint (i.e. having the same size and shape of base and appropriate holes/recesses).

In an advantage over firearms and sight assemblies of the prior art, aspects described herein provide a closed sight which by being designed to function with a significantly smaller footprint, has been made to match an existing footprint of a smaller open sight. The reflector sights described herein can therefore be quickly and easily interchanged with other (open) sights. The closed sight can be swapped with the open sight, without requiring structural modifications of the mounting plate or slide.

In a further advantage, through the use of a suitable adjustment mechanism, such as 15 or the one described in UK patent publication no. GB2572831, the sight 1 of the present example embodiment can be positioned relatively low down on the firearm. Thus, the process of calibrating the sight to find a co-witness between the bridge, the lens and the iron sights (when present) is made simpler and easier.

Whilst aspects described herein have been described and illustrated with reference to particular embodiments, it will be appreciated by those of ordinary skill in the art that aspects described herein lend themselves to many different variations not specifically illustrated herein.

Where in the foregoing description, integers or elements are mentioned which have known, obvious or foreseeable equivalents, then such equivalents are herein incorporated as if individually set forth. Reference should be made to the claims for determining the true scope of any claimed embodiment, which should be construed so as to encompass any such equivalents. It will also be appreciated by the reader that integers or features that are described as preferable, advantageous, convenient or the like are optional and do not limit the scope of the independent claims. Moreover, it is to be understood that such optional integers or features, whilst of possible benefit in some embodiments, may not be desirable, and may therefore be absent, in other embodiments.

What is claimed is:

1. A reflector sight for a firearm, comprising:

a base;

a housing arranged on the base, together defining an inner chamber; and a light source, wherein the base comprises a bridge defining a tunnel therethrough, and wherein the light source is arranged with respect to the base to emit light through the tunnel and into the inner chamber, wherein the reflector sight is a closed sight, and wherein the bridge is raised up from a top surface of the base.

2. The reflector sight according to claim 1, wherein the light source is positioned beneath a top surface of the base.

3. The reflector sight according to claim 1, wherein the base comprises one or more holes for receiving mounting screws, the holes being positioned forward of the light source.

4. The reflector sight according to claim 1, wherein the bridge comprises one or more walls, the walls having a maximum thickness of less than 1.5 mm.

5. The reflector sight according to claim 1, wherein the bridge comprises a transparent cover.

6. The reflector sight according to claim 5, wherein the transparent cover is angled with respect to an upper surface of the base.

7. The reflector sight according to claim 1, wherein:

the housing comprises a rear window adjacent the bridge, and the bridge covers less than 10% of an external surface area of the rear window.

8. The reflector sight according to claim 1, wherein the bridge is elongate, having a maximum length greater than a maximum width and a maximum height.

9. The reflector sight according to claim 1, wherein the bridge is aligned centrally on the base.

10. The reflector sight according to claim 1, wherein the reflector sight comprises a lens in the inner chamber.

11. The reflector sight according to claim 1, wherein the tunnel extends beneath a top surface of the base to a lower tunnel end, and the light source is mounted at the lower tunnel end.

12. A reflector sight assembly, comprising:

a reflector sight, comprising:

a base;

a housing arranged on the base, together defining an inner chamber; and a light source, wherein the base comprises a bridge defining a tunnel therethrough, and wherein the light source is arranged with respect to the base to emit light through the tunnel and into the inner chamber; and a mount configured to hold the reflector sight, wherein the reflector sight is a closed sight, and wherein the bridge is raised up from a top surface of the base.

13. The reflector sight assembly according to claim 12, wherein the mount is a mounting plate configured to attach to a firearm, or a portion of a slide of the firearm.

14. A firearm, comprising:

a reflector sight assembly, comprising:

a reflector sight, comprising:

a base;

a housing arranged on the base, together defining an inner chamber; and a light source, wherein the base comprises a bridge defining a tunnel therethrough, and wherein the light source is arranged with respect to the base to emit light through the tunnel and into the inner chamber; and a mount configured to hold the reflector sight, wherein the reflector sight is a closed sight, and wherein the bridge is raised up from a top surface of the base.

15. The firearm according to claim 14, wherein the mount is a mounting plate configured to attach to the firearm, or a portion of a slide of the firearm.

16. A closed reflector sight for mounting on a firearm, comprising:

a base comprising a housing;

a raised bridge portion adjacent the housing, wherein the raised bridge portion comprises one or more walls, the walls having a maximum thickness of less than 1.5 mm; and a light source arranged with respect to the base to emit light through the raised bridge portion and into the housing.

* * * * *